US007591289B1

(12) United States Patent
Hamada

(10) Patent No.: US 7,591,289 B1
(45) Date of Patent: Sep. 22, 2009

(54) COOLING SYSTEM BLEEDER SYSTEM

(76) Inventor: Jim S. Hamada, 1846 W. 162nd St., Gardena, CA (US) 90247

( * ) Notice: Subject to any disclaimer, the term of this patent is extended or adjusted under 35 U.S.C. 154(b) by 290 days.

(21) Appl. No.: 11/468,495

(22) Filed: Aug. 30, 2006

(51) Int. Cl.
*B65B 3/04* (2006.01)
*B65B 39/04* (2006.01)

(52) U.S. Cl. ..... 141/65; 141/94; 141/290; 141/300; 141/301; 141/344; 141/365; 141/391

(58) Field of Classification Search ..... 141/65, 141/94, 247, 290, 297, 300, 301, 331, 332, 141/344, 363, 365, 366, 391
See application file for complete search history.

(56) References Cited

U.S. PATENT DOCUMENTS

| | | | | | |
|---|---|---|---|---|---|
| 1,676,986 | A | * | 7/1928 | Hilford | 141/300 |
| 2,584,216 | A | * | 2/1952 | Morrison | 141/300 |
| 3,601,181 | A | | 8/1971 | Avera | |
| 4,461,342 | A | | 7/1984 | Avrea | |
| 4,606,363 | A | * | 8/1986 | Scales | 134/111 |
| 4,785,874 | A | | 11/1988 | Avrea | |
| 4,888,980 | A | * | 12/1989 | DeRome | 73/49.2 |
| 4,916,941 | A | | 4/1990 | Briggs | |
| 5,228,488 | A | * | 7/1993 | Fletcher | 141/331 |
| 5,329,982 | A | * | 7/1994 | Payne | 165/95 |
| 5,427,505 | A | * | 6/1995 | Payne | 417/149 |
| D359,919 | S | | 7/1995 | Jorgensen | |
| 5,615,716 | A | * | 4/1997 | Akazawa | 141/91 |
| 5,649,574 | A | * | 7/1997 | Turcotte et al. | 141/67 |
| 5,676,185 | A | * | 10/1997 | Starr et al. | 141/300 |
| 5,853,068 | A | * | 12/1998 | Dixon et al. | 141/331 |
| 5,950,695 | A | * | 9/1999 | Smith | 141/326 |
| 6,135,067 | A | | 10/2000 | Klamm et al. | |
| 6,161,566 | A | * | 12/2000 | Klamm | 141/65 |
| 6,604,557 | B2 | * | 8/2003 | Awad | 141/65 |
| 6,806,092 | B1 | * | 10/2004 | Pool | 436/137 |
| 6,863,099 | B2 | * | 3/2005 | Watkins | 141/345 |
| 6,883,533 | B2 | * | 4/2005 | Knowles et al. | 141/42 |
| 7,017,628 | B2 | * | 3/2006 | Najafi | 141/297 |
| 7,111,650 | B2 | * | 9/2006 | Few | 141/98 |
| 2005/0022754 | A1 | * | 2/2005 | Pool et al. | 123/41.15 |

* cited by examiner

*Primary Examiner*—Timothy L Maust
*Assistant Examiner*—Nicolas A Arnett

(57) ABSTRACT

A cooling system bleeder system for permitting air to be bled from a cooling system of a vehicle to reduce spillage of coolant during the bleeding process includes a container for receiving coolant to be supplied to the coolant system. The container has an upper open end to permit the coolant to be poured into the container. The container includes a lower open end permitting the coolant to drain from the container. A valve is coupled to the container adjacent to and over the lower open end. The valve is selectively actuated to an open position to permit the coolant in the container to drain from the container and selectively actuated to a closed position to discontinue draining of the coolant from the container. A cap is couplable to the container adjacent the upper open end to selectively close the upper open end of the container.

6 Claims, 4 Drawing Sheets

COOLING SYSTEM BLEEDER SYSTEM

BACKGROUND OF THE INVENTION

1. Field of the Invention

The present invention relates to air bleeding systems and more particularly pertains to a new air bleeding system for permitting air to be bled from a cooling system of a vehicle to reduce spillage of coolant during the bleeding process.

2. Description of the Prior Art

The use of air bleeding systems is known in the prior art. The prior art commonly teaches the use of a container that is coupled to an upper return pipe of a radiator to allow coolant to be supplied to the coolant system. While these devices fulfill their respective, particular objectives and requirements, the need remains for a system that has certain improved features that allow for coolant to be added to a coolant system through a fill aperture of a radiator to minimize spilling of the coolant fluid when the coolant system is being bled. Additionally, the system may include a detecting system incorporated to detecting combustion gasses in the cooling system to alert a person to a possible leak in the cooling system.

SUMMARY OF THE INVENTION

The present invention meets the needs presented above by generally comprising a container being configured to receive coolant to be supplied to the coolant system. The container includes an upper open end to permit the coolant to be poured into the container. The container includes a lower open end permitting the coolant to drain from the container. A valve is coupled to the container adjacent to and over the lower open end. The valve is selectively actuated to an open position to permit the coolant in the container to drain from the container and selectively actuated to a closed position to discontinue draining of the coolant from the container. A cap is couplable to the container adjacent the upper open end to selectively close the upper open end of the container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
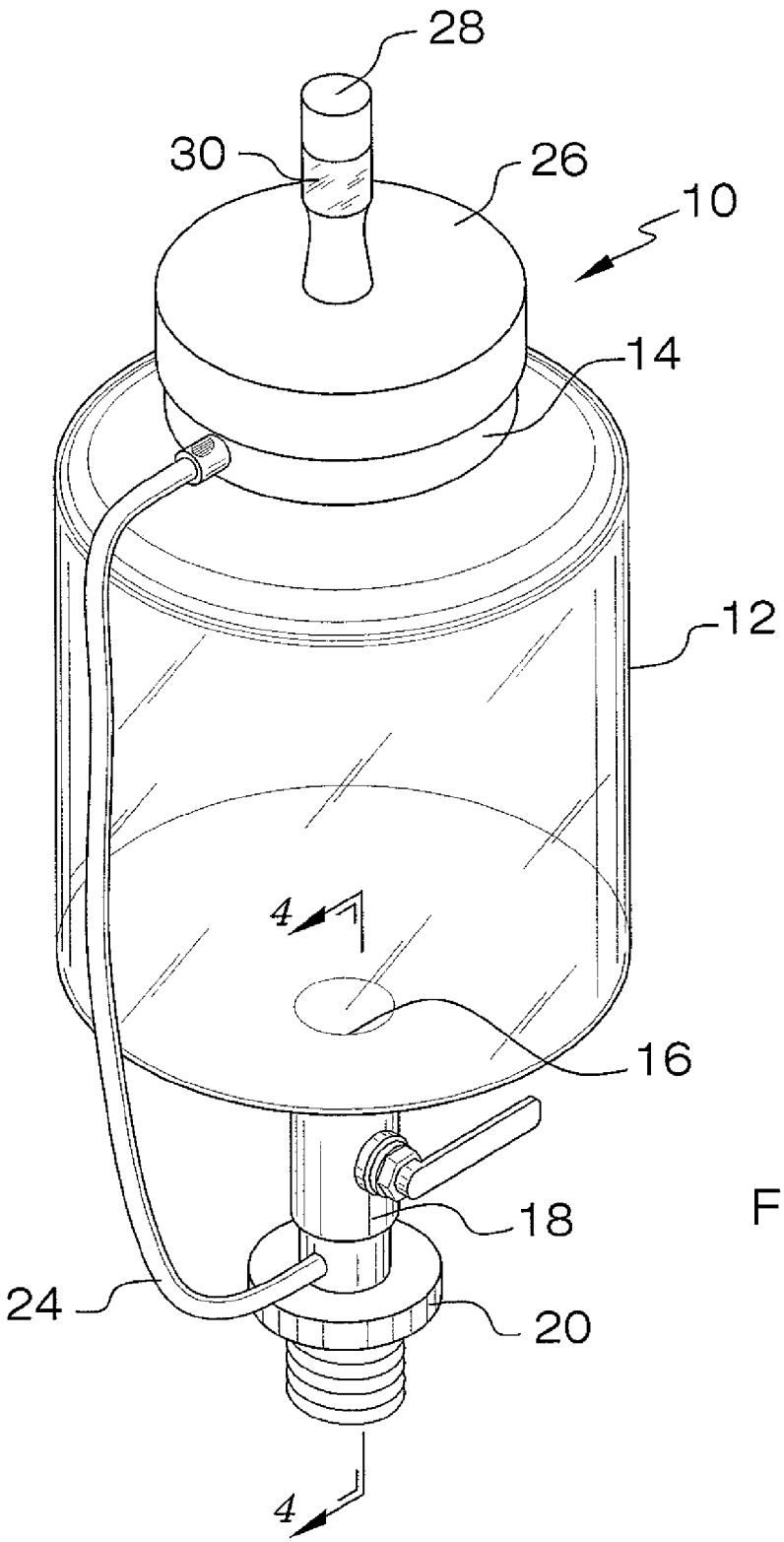
FIG. 1 is a perspective view of a cooling system bleeder system according to the present invention.
Figure 2:
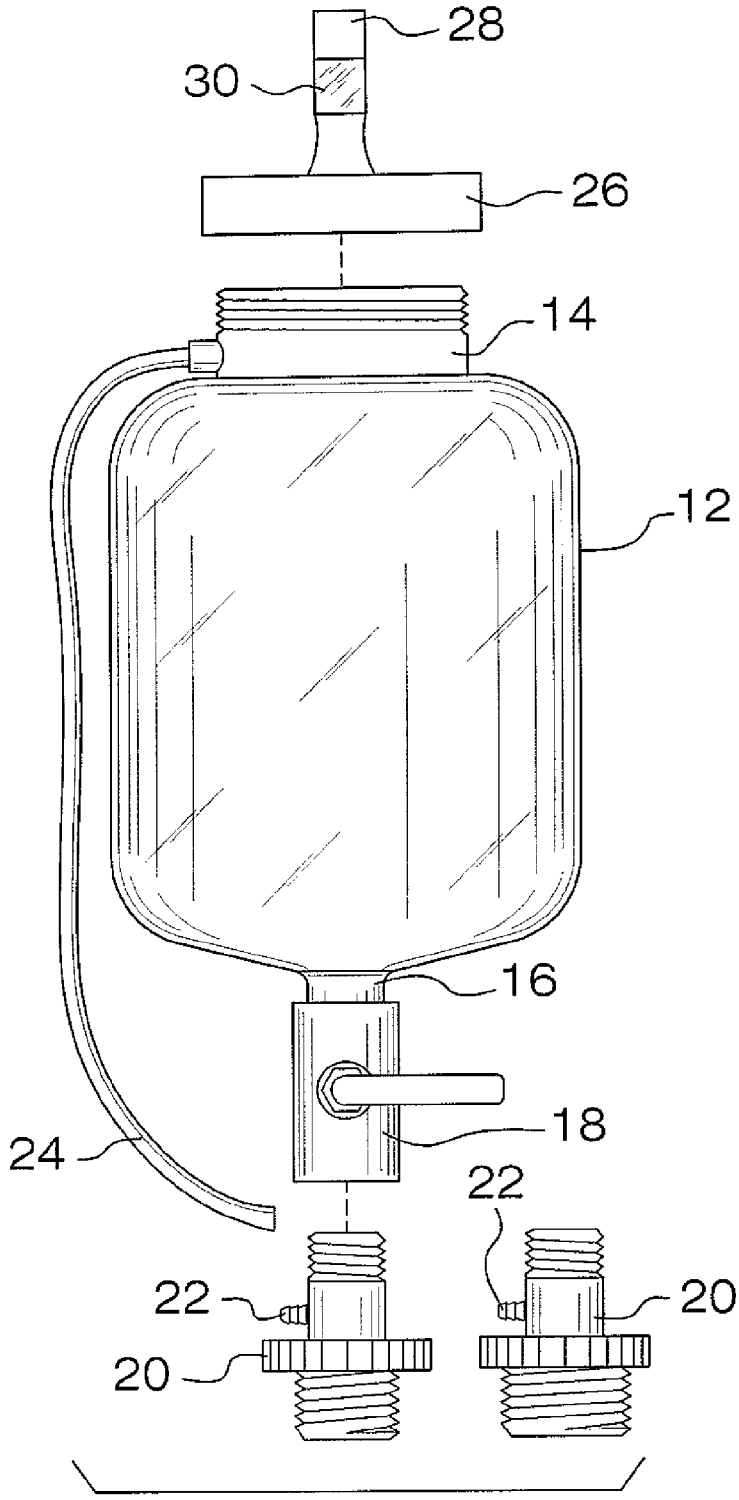
FIG. 2 is an exploded front view of the present invention showing a plurality of adapters.
Figure 3:
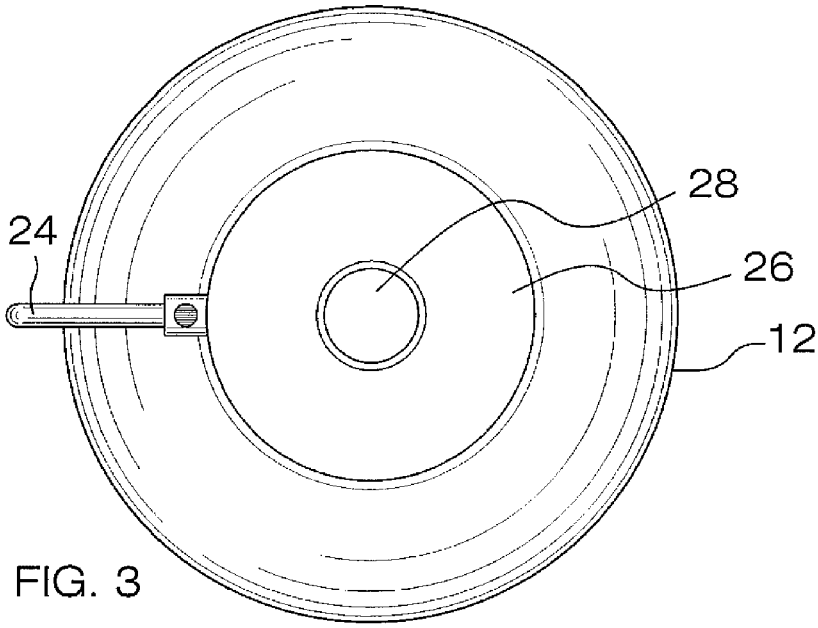
FIG. 3 is a top view of the present invention.
Figure 4:
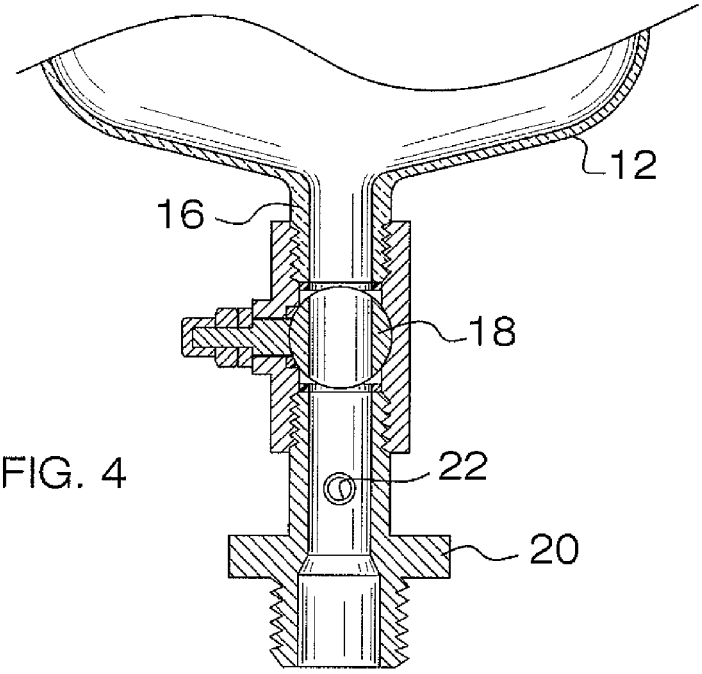
FIG. 4 is a cross-sectional view of the present invention taken along line 4-4 of FIG. 1.
Figure 5:
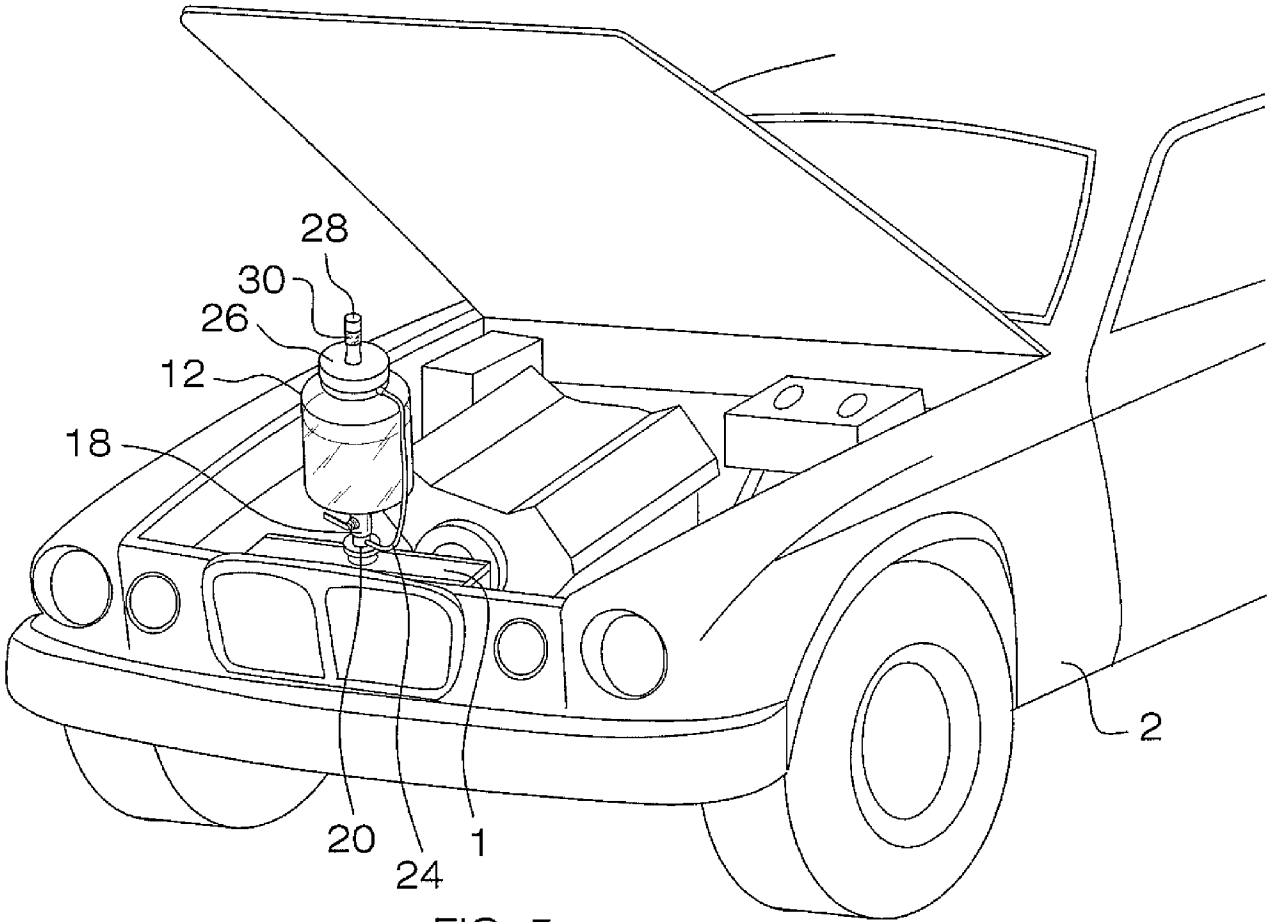
FIG. 5 is a perspective view of the present invention shown in use.

With reference now to the drawings, and in particular to FIGS. 1 through 5 thereof, a new air bleeding system embodying the principles and concepts of the present invention and generally designated by the reference numeral 10 will be described.

As best illustrated in FIGS. 1 through 5, the cooling system bleeder system 10 generally comprises a container 12 being configured to receive coolant to be supplied to a coolant system. The container 12 includes an upper open end 14 to permit coolant to be poured into the container 12. The container 12 includes a lower open end 16 permitting the coolant to drain from the container 12. The container 12 is comprised of a transparent material to permit viewing of the coolant in the container 12. A valve 18 is coupled to the container 12 adjacent to and over the lower open end 16. The valve 18 is selectively actuated to an open position to permit the coolant in the container 12 to drain from the container 12. The valve 18 is selectively actuated to a closed position to discontinue draining of the coolant from the container 12.

At least one adapter 20 is couplable to the valve 18 opposite the container 12. The at least one adapter 20 engages a radiator 1 of a vehicle 2 to create an airtight seal with the radiator 1. The at least one adapter 20 permits the coolant passing through the valve 18 to enter the radiator 1. The at least one adapter 20 includes a bypass pipe 22 being integrally coupled to and in fluid communication with the at least one adapter 20. A vent hose 24 is coupled to and outwardly extends from the container 12 adjacent to the upper open end 14. The vent hose 24 is couplable to the at least one adapter 20 to permit fluid communication with the at least one adapter 20. The vent hose 24 receives air passing into the at least one adapter 20 and directs the air into the container 12. The vent hose 24 slidably receives the bypass pipe 22 to couple the vent hose 24 to the at least one adapter 20.

A cap 26 is couplable to the container 12 adjacent the upper open end 14 to selectively close the upper open end 14 of the container 12. A detecting system 28 is coupled to the cap 26. The detecting system 28 outwardly extends from the cap 26 to permit viewing of the detecting system 28 when coolant is being drained into the radiator 1 and the cap 26 is coupled to the container 12. The detecting system 28 is in fluid communication with the upper open end 14 of the container 12. The detecting system 28 includes a reactive material 30 being reactive to gasses, such as hydrocarbons or carbon dioxide, produced during combustion to indicate the presence of combustion gasses in the coolant system of the vehicle 2. The detecting system 28 is viewable to alert a person to the presence of combustion gasses in the coolant system when the coolant system is being bled.

In use, the at least one adapter 20 is coupled to the radiator 1 of the vehicle 2 and secured to the valve 18 with the container 12 attached to the valve 18. The vent hose 24 is then connected to the bypass pipe 22. The container 12 is then filled with coolant through the upper open end 14 of the container 12. The cap 26 is coupled to the upper open end 14 of the container 12. The valve 18 is actuated to the open position to allow the coolant to pass through the valve 18 and into the coolant system. As air is purged from the coolant system it passes through the at least one adapter 20, into the vent hose 24 and into the container 12. The detecting system 28 comes into contact with the air from the coolant system and the reactive material 30 alerts the person if combustion gasses are present, which may indicate a leak in the coolant system of the vehicle 2.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bleeder system for bleeding air from a cooling system of a vehicle, said bleeder system comprising:

a container being configured to receive coolant to be supplied to the cooling system, said container including an upper open end to permit the coolant to be poured into said container, said container including a lower open end permitting the coolant to drain front said container;

a valve being coupled to said container adjacent to and over said lower open end, said valve being selectively actuated to an open position to permit the coolant in said container to drain from said container, said valve being selectively actuated to a closed position to discontinue draining or the coolant from said container;

at least one adapter being coupled to said valve opposite said container, said at least one adapter engageable with the cooling system of the vehicle to create an airtight seal with the cooling system, said at least one adapter permitting the coolant passing through said valve to enter the cooling system;

a cap being couplable to said container adjacent said upper open end to selectively close said upper open end of said container; and a vent hose being coupled to and outwardly extending from said container adjacent said upper open end, said vent hose being couplable to said at least one adapter to permit fluid communication with said at least one adapter, said vent hose receiving air passing into said at least one adapter and directing air into said container.

2. The system according to claim 1, wherein said container is comprised of a transparent material to permit viewing of the coolant in said container.

3. The system according to claim 1, wherein said at least one adapter includes a bypass pipe being integrally coupled to and in fluid communication with said at least one adapter, said vent hose slidably receiving said bypass pipe to couple said vent hose to said at least one adapter.

4. The system according to claim 1, further comprising a detecting system being coupled to said cap, said detecting system outwardly extending from said cap to permit viewing of said detecting system when coolant is being drained into the cooling system and said cap is coupled to said container, said detecting system being in fluid communication with said upper open end of said container, said detecting system detecting combustion gasses in the coolant and being viewed by a person to alert the person to combustion gasses in the coolant.

5. The system according to claim 4, wherein said detecting system includes a reactive material being reactive to gasses produced during combustion to indicate the presence of combustion gasses in the cooling system of the vehicle, said detecting system being viewed to alert a person to the presence of combustion gasses in the cooling system when the cooling system is being bled.

6. A bleeder system for bleeding air from a cooling system of a vehicle, said bleeder system comprising:

a container being configured to receive coolant to be supplied to the cooling system, said container including an upper open end to permit the coolant to be poured into said container, said container including a lower open end permitting the coolant to drain from said container, said container being comprised of a transparent material to permit viewing of the coolant in said container;

a valve being coupled to said container adjacent to and over said lower open end, said valve being selectively actuated to an open position to permit the coolant in said container to drain from said container, said valve being selectively actuated to a closed position to discontinue draining of the coolant from said container;

at least one adapter being couplable to said valve opposite said container, said at least one adapter engageable with the cooling system of the vehicle to create an airtight seal with the cooling system, said at least one adapter permitting the coolant passing through said valve to enter the cooling system, said at least one adapter including a bypass pipe being integrally coupled to and in fluid communication with said at least one adapter;

a vent hose being coupled to and outwardly extending from said container adjacent said upper open end, said vent hose being couplable to said at least one adapter to permit fluid communication with said at least one adapter, said vent hose receiving air passing into said at least one adapter and directing air into said container, said vent hose slidably receiving said bypass pipe to couple said vent hose to said at least one adapter;

a cap being couplable to said container adjacent said upper open end to selectively close said upper open end of said container; and a detecting system being coupled to said cap, said detecting system outwardly extending from said cap to permit viewing of said detecting system when coolant is being drained into the cooling system and said cap is coupled to said container, said detecting system being in fluid communication with said upper open end of said container, said detecting system including a reactive material being reactive to gasses produced during combustion to indicate the presence of combustion gasses in the cooling system of the vehicle, said detecting system being viewed to alert a person to the presence of combustion gasses in the cooling system when the cooling system is being bled.

* * * * *